US005463365A

United States Patent [19]

Iwatani et al.

[11] Patent Number: 5,463,365

[45] Date of Patent: Oct. 31, 1995

[54] COIL

[75] Inventors: Hidetoshi Iwatani; Masato Fujino; Shinji Matsumoto; Choichiro Fujii; Masakazu Kazama, all of Nagaokakyo, Japan

[73] Assignee: Murata Mfg. Co., Ltd., Japan

[21] Appl. No.: 146,783

[22] Filed: Nov. 2, 1993

[30] Foreign Application Priority Data

Nov. 2, 1992 [JP] Japan ..... 4-317840

[51] Int. Cl.[6] ..... H01F 15/10; H01F 27/02; H01F 27/30

[52] U.S. Cl. ..... 336/98; 336/65; 336/192; 336/200; 336/232

[58] Field of Search ..... 336/200, 232, 336/192, 65, 83, 90, 98; 29/602.1

[56] References Cited

U.S. PATENT DOCUMENTS

| | | | |
|---|---|---|---|
| 4,641,114 | 2/1987 | Person | 336/200 |
| 4,873,757 | 10/1989 | Williams | 29/602.1 |

FOREIGN PATENT DOCUMENTS

| | | | |
|---|---|---|---|
| 2230587 | 4/1980 | Germany | 336/200 |
| 47-21490 | 6/1972 | Japan | 336/200 |
| 54-110424 | 8/1979 | Japan | 336/200 |
| 3-283415 | 12/1991 | Japan | 336/200 |
| 3-283404 | 12/1991 | Japan | 336/192 |
| 5-82350 | 4/1993 | Japan | 336/200 |

*Primary Examiner*—Thomas J. Kozma
*Attorney, Agent, or Firm*—Ostrolenk, Faber, Gerb & Soffen

[57] ABSTRACT

A coil contains a winding part and a core. The winding part is formed of plural laminated sheets each having a winding pattern. Plural winding patterns are formed on at least one sheet. Each of the winding patterns has a different number of turns, and the winding patterns are formed around the core so as to be coaxial in the same winding direction. The winding patterns formed on the other sheets are connected via a through-hole, and an end of the winding pattern is connected to an input/output portion formed outside of the sheet.

20 Claims, 6 Drawing Sheets

COIL

BACKGROUND OF THE INVENTION

1. Field of the Invention

The present invention relates to a coil, and more particularly, it relates to a coil such as laminate type transformer which is mounted on the printed-circuit board.

2. Description of the Prior Art

As a conventional laminate type coil, there is a coil containing a winding part wherein plural sheets each having a winding pattern are laminated, and the winding patterns formed on the sheets are connected. As shown in FIG. 9, a sheet 1 on which one spiral winding pattern 2 is formed is used in the winding part of the coil. A hole 3 for inserting a core is formed through the sheet 1, and the spiral winding pattern 2 is formed around the hole 3. Both ends of the winding pattern 2 are connected to electrodes on the outside and the inside of the sheet 1.

As shown in FIG. 10, a winding pattern 5 is formed on the other sheet 4. The winding pattern 2 is connected to the winding pattern 5 at the inside of the sheet 1 and the sheet 4. Therefore, a winding is formed between the input/output portions where the winding patterns are connected to electrodes on the outside of the sheet 1 and the sheet 4. Another winding is formed by forming winding patterns whose number of turns are different from above winding patterns on another two sheets, and forming the same structure as above. A transformer is manufactured by coupling the two windings magnetically with a core.

However, in the conventional coil, at least two sheets are required for forming one winding, because the input/output portions for connecting to the external circuit are formed at the outside of the sheets. When the transformer is manufactured, the number of sheets is increased because plural windings are required. Therefore, manufacturing cost of the coil is high, and miniaturization such as forming a thin type coil is difficult.

SUMMARY OF THE INVENTION

Therefore, the main object of the present invention is to provide a coil whose manufacturing cost is low, and miniaturization such as forming a thin type coil is possible.

The present invention is a coil containing a winding part which is formed by laminating plural sheets each having a winding pattern, and a core disposed at the center of the winding patterns, and wherein plural winding patterns each having different number of turns are formed on one of the sheets around the core so as to be coaxial in the same winding direction.

Since plural winding patterns are formed so as to be coaxial in the same winding direction, the winding patterns each having different number of turns can be formed on one sheet. Since plural winding patterns are formed on one sheet, plural windings are formed with two sheets. Since plural windings are formed around the core, the windings are coupled magnetically.

According to the present invention, since plural winding patterns are formed on one sheet, the coil having plural windings with a small number of sheets can be obtained. Therefore, the winding part can be thin as compared with a conventional coil, and miniaturization of the coil, such as a thin type coil, is possible. Since the number of sheets can be decreased, it is possible to decrease the manufacturing cost of the coil. Since plural windings can be coupled magnetically with a core, the coil can be used as a transformer.

DESCRIPTION OF THE PREFERRED EMBODIMENTS

Figure 1:
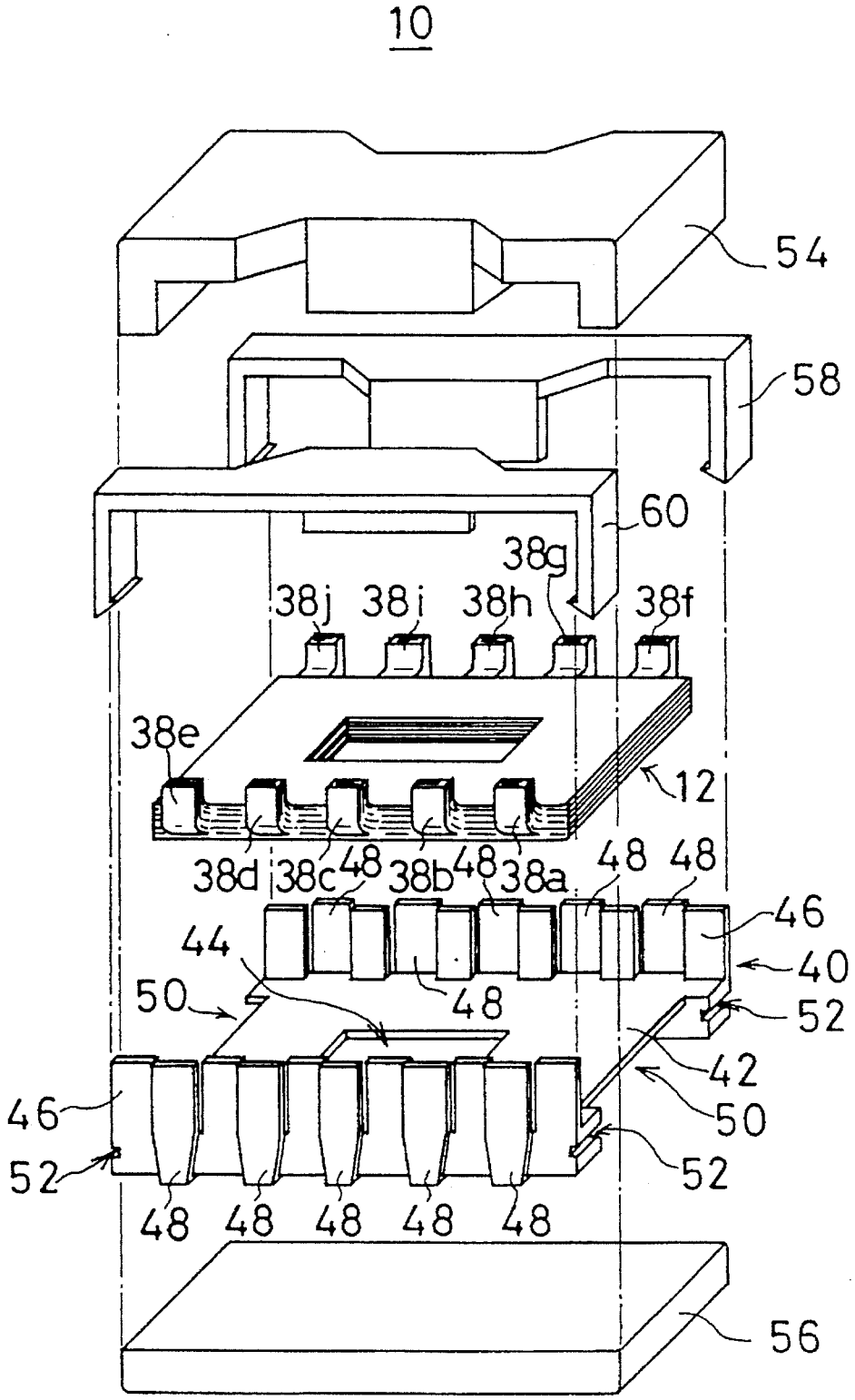
FIG. 1 is an exploded perspective view showing an embodiment of the present invention.
Figure 2:
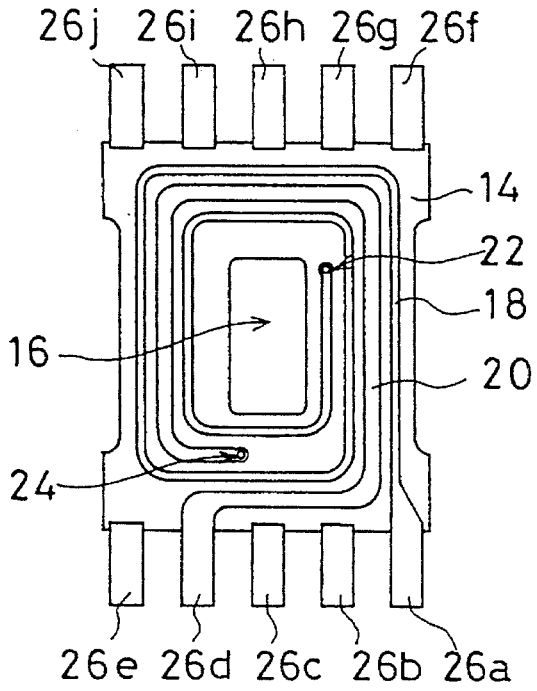
FIG. 2 and FIG. 3 are plan views showing sheets used in a winding part of the coil of FIG. 1.

FIG. 1 is an exploded perspective view showing an embodiment of the present invention. A coil 10 contains a winding part 12. The winding part 12 is formed by laminating plural sheets. The sheets are formed with an insulation material such as polyimide resin. As shown in FIG. 2, a hole 16 for inserting a core is formed through the sheet 14. On the sheet 14, a first winding pattern 18 and a second winding pattern 20 are formed around the hole 16. The first winding pattern 18 is formed so as to have 2.5 turns from one end of the sheet 14. A through-hole 22 is formed at an inner end of the first winding pattern 18. The second winding pattern 20 is formed so as to have 1 turn from one end of the sheet 14. A through-hole 24 is formed at an inner end of the second winding pattern 20. The first winding pattern 18 and the second winding pattern 20 are formed around the hole 16 so as to be coaxial in the same winding direction.

Plural input/output portions 26*a*, 26*b*, 26*c*, 26*d*, 26*e*, 26*f*, 26*g*, 26*h*, 26*i* and 26*j* are formed at opposite ends of the sheet 14. The first winding pattern 18 is connected to the input/output portion 26*a*, and the second winding pattern 20 is connected to the input/output portion 26*d*. The other input/output portions 26*b*, 26*c*, 26*e*, 26*f*, 26*g*, 26*h*, 26*i* and 26*j* are dummy portions.

Figure 3:
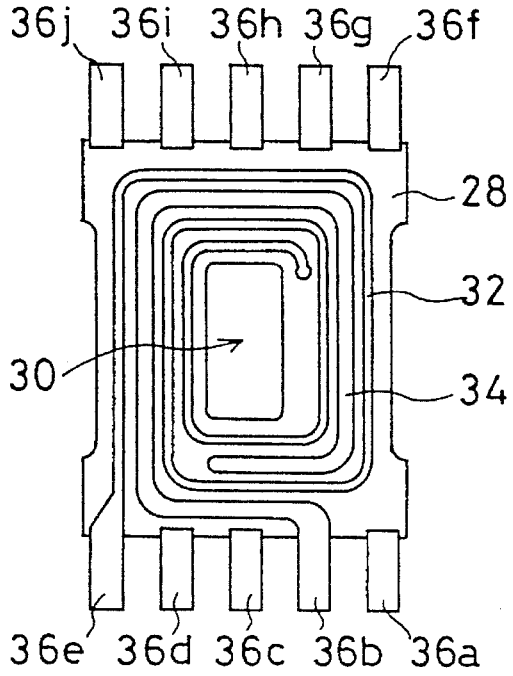

Another sheet 28 is prepared. As shown in FIG. 3, a hole 30 for inserting a core is formed through the sheet 28. A third winding pattern 32 and a fourth winding pattern 34 are formed around the hole 30. The third winding pattern 32 is formed so as to have 2.5 turns from the portion corresponding to the through-hole 22 of the first winding pattern 18, and extends to one end of the sheet 28. The fourth winding pattern 34 is formed so as to have 1 turn from the portion corresponding to the through-hole 24 of the second winding pattern 20, and extends to one end of the sheet 28. The third winding pattern 32 and the fourth winding pattern 34 are formed around the hole 30 so as to be coaxial in the same winding direction. Plural input/output portions 36*a*, 36*b*, 36*c*, 36*d*, 36*e*, 36*f*, 36*g*, 36*h*, 36*i* and 36*j* are formed at opposite ends of the sheet 28. The third winding pattern 32 is connected to the input/output portion 36*e*, and the fourth winding pattern 34 is connected to the input/output portion 36*b*. The other take-out portions 36*a*, 36*c*, 36*d*, 36*f*, 36*g*, 36*h*, 36*i* and 36*j* are dummy portions.

Two sheets 14 and 28 are laminated. The first winding pattern 18 is connected to the third winding pattern 32 via the through-hole 22. The second winding pattern 20 is connected to the fourth winding pattern 34 via the through-hole 24. In the state of laminating two sheets 14 and 28, the input/output portions 26*a*–26*j* are put upon the input/output portions 36*a*–36*j* respectively, and input/output electrodes 38*a*, 38*b*, 38*c*, 38*d*, 38*e*, 38*f*, 38*g*, 38*h*, 38*i* and 38*j* are formed. Therefore, in the winding part 12, a winding having 5 turns is formed between the output/output electrodes 38*a* and 38*e*, and a winding having 2 turns is formed between the input/output electrodes 38*b* and 38*d*.

The winding part 12 is installed to a terminal board 40. The terminal board 40 contains a plate portion 42. A hole 44 for inserting a core is formed at a center of the plate portion 42. A terminal holding portions 46 are formed at opposite sides of the plate portion 42. The terminal holding portion 46 is formed so as to be orthogonal to the plate portion 42, and is divided at corresponding portion to the winding part 12. Plural terminals 48 are formed at divided portions of the terminal holding portion 46. The terminals 48 are formed at a distance from each other at outside of the terminal holding portion 46. Therefore, the terminal holding portion 46 and the terminals 48 are positioned alternately at different locations along the winding part 12. The terminals 48 are formed so as to be exposed to the outside, and besides, the upper portions of the terminals 48 are formed so as to be exposed to the inside. Hollows 50 are formed at both sides of the plate portion 42 of the terminal board 40. Grooves 52 are formed at both sides of the terminal holding portions 46.

The winding part 12 is installed on the terminal board 40. The winding part 12 and the terminal board 40 are disposed so as to overlap the holes 16, 30 with the hole 44, and the input/output electrodes 38*a*–38*j* are put into the caves which are formed with the terminal holding portions 46 and the terminals 48. The take-out electrodes 38*a*–38*j* of the winding part 12 are connected to the terminals 48 of the terminal board 40 by means of welding or soldering.

A core 54 having a cross sectional E shape and a core 56 having a cross sectional I shape are installed from both sides of the winding part 12 and the terminal board 40. A center leg of the core 54 is inserted to the holes 16, 30 of the winding part 12 and the hole 44 of the terminal board 40. Legs of both sides of the core 54 are put in the hollows 50 of the plate portion 42. In this situation, two cores 54 and 56 are placed opposite to each other and fixed. Covers 58 and 60 are installed at both sides of the core 54. The covers 58 and 60 have a cross sectional U shape, and projections are formed at the ends of the covers 58 and 60 extending toward a center of the plate portion 42. The covers 58 and 60 are fixed to the terminal board 40 by putting the projections into the grooves 52 of the terminal holding portion 46. In FIG. 1, the center portion of the core 54 is narrow, and the covers 58 and 60 have corresponding shapes to the core 54, however the core 54 may have a uniform width. In this case, the covers 58 and 60 are formed so as to have uniform width. The covers 58 and 60 are not always required, and the covers 58 and 60 may be taken away in the case of using the coil in a dustless environment.

The coil 10 is used as a transformer since two windings have different number of turns. In the coil 10, the winding patterns 18 and 20 each having different number of turns are formed on the sheet 14, and the winding patterns each having different number of turns are formed on the sheet 28. Therefore, two windings are formed with two sheets. In the conventional coil, two sheets are required for forming one winding, and thus four sheets are required for forming a transformer. That is, in the coil 10 of the present invention, the number of sheets can be reduced by half as compared with the conventional coil. Therefore, the manufacturing cost of the coil 10 can be reduced, and the coil 10 can be formed in a thin shape.

In the above embodiment, the transformer is manufactured by forming two windings, however three or more windings may be formed. In this case, three or more winding patterns may be formed on one sheet, and may be formed on plural sheets. When three or more winding patterns are formed on one sheet, three or more windings are formed by laminating two sheets similarly to the above embodiment. When the winding patterns are formed on plural sheets, the number of sheets can be .reduced by forming two or more winding patterns on one sheet. In the above embodiment, the first winding pattern 18, the second winding pattern 20, the third winding pattern 32 and the fourth winding pattern 34 may be formed on both surfaces of the sheet 14. In this case, two windings are formed with one sheet by connecting the winding patterns via through-holes.

Figure 4:
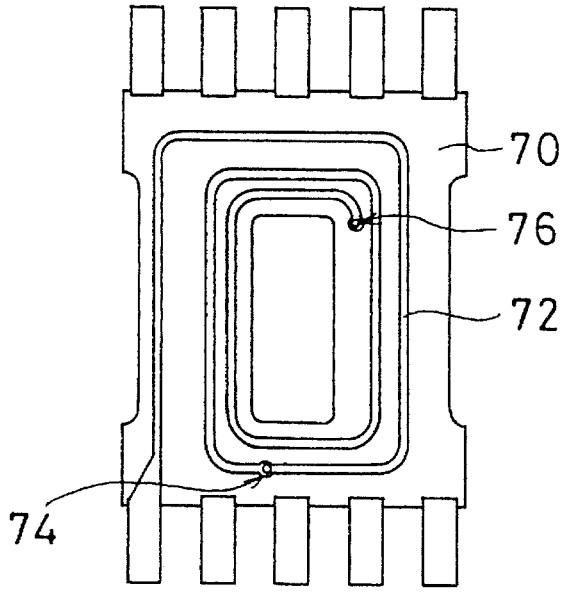
FIG. 4 and FIG. 5 are plan views showing other sheets used in a winding part of the coil of FIG. 1
Figure 5:
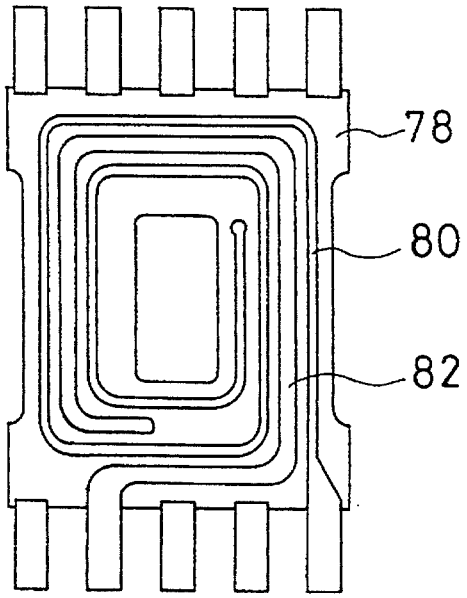
Figure 6:
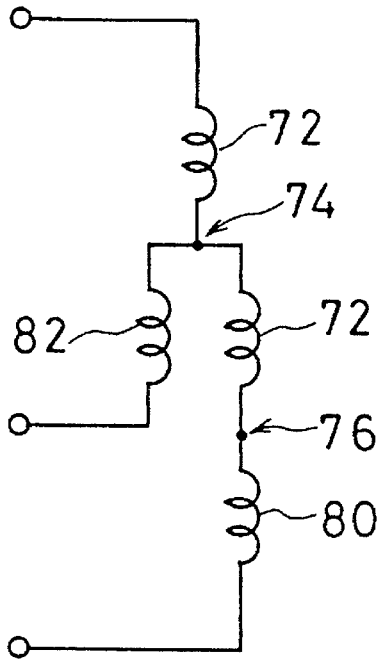
FIG. 6 is an equivalent circuit diagram of the coil which uses the sheets of FIG. 4 and FIG. 5.

As shown in FIG. 4 and FIG. 5, the intermediate portion of the winding pattern may be connected to others. In this embodiment, a first winding pattern 72 is formed on a sheet 70. A through-hole 74 and a through-hole 76 are formed at an intermediate portion and an end portion of the first winding pattern 72. A second winding pattern 80 and a third winding pattern 82 each having different number of turns are formed on the other sheet 78. The end of the second winding pattern 80 is disposed at a portion corresponding to the through-hole 76 which is formed at the end of the first winding pattern 72. The end of the third winding pattern 82 is disposed at a portion corresponding to the through-hole 74 which is formed at the intermediate portion of the first winding pattern 72. The first winding pattern 72 is connected to the second winding pattern 80 via the through-hole 76, and the first winding pattern 72 is connected to the third winding pattern 82 via the through-hole 74. As shown in an eqivalent circuit diagram of FIG. 6, the coil 10 is a multi-output coil including a common circuit.

Figure 7:
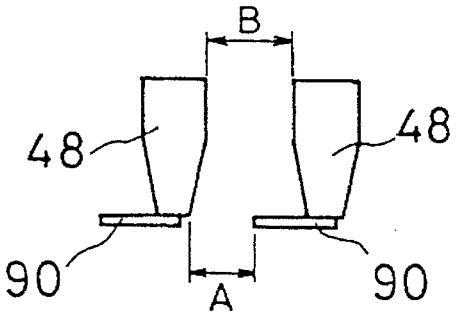
FIG. 7 is an illustrative view showing a relation between a terinal and a pattern electrode when the coil is mounted on a printed-circuit board.

In the case of forming the terminals 48 whose both ends have different widths as shown in FIG. 1, when the coil 10 is mounted on the printed-circuit board, as shown in FIG. 7, the insulating distance A between the under portion of the terminal 48 and the adjacent pattern electrode 90 of the printed-circuit board can be long, even when the terminal 48 is disposed to the pattern electrode 90 in a shifted position. Therefore, the distance B between the adjacent terminals can be short as compared with the case of forming the terminal 48 having a uniform width, and thus the coil 10 can be miniaturized.

Figure 8:
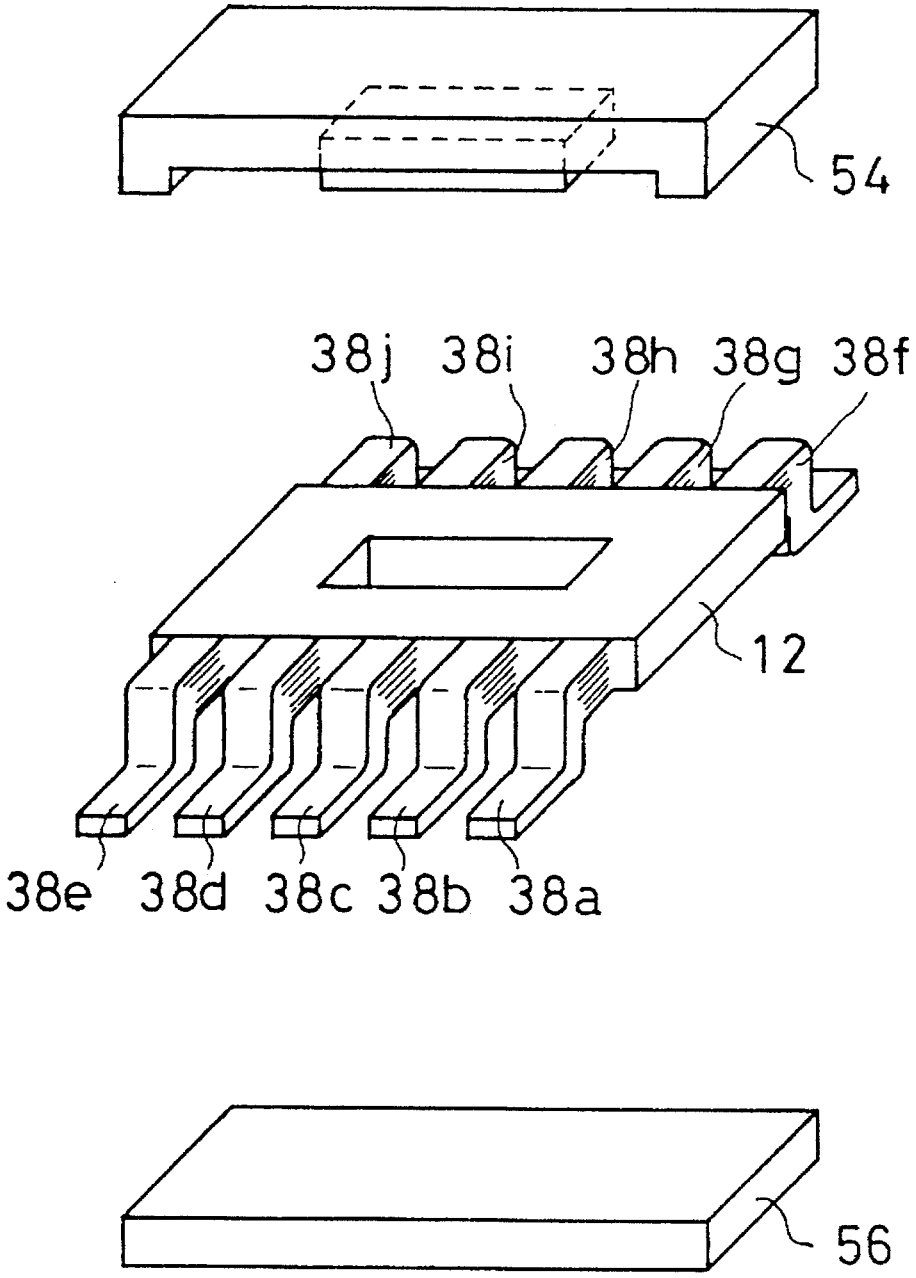
FIG. 8 is an exploded perspective view showing another embodiment of the present invention.
Figure 9:
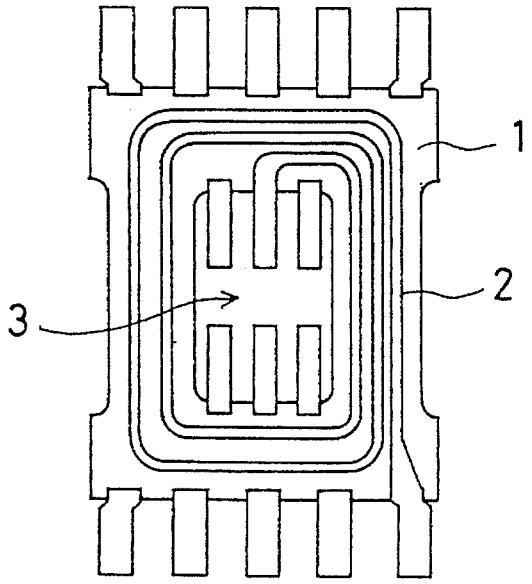
FIG. 9 PRIOR ART
FIG. 9 and FIG. 10 are plan views showing sheets used in a conventional coil which is background of the present invention.
Figure 10:
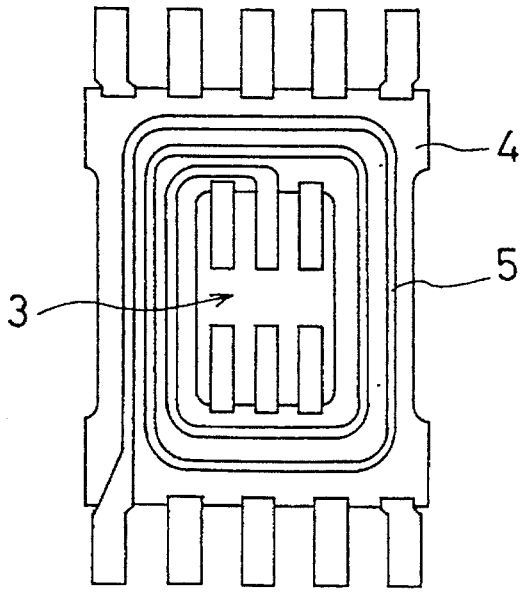
FIG. 10 PRIOR ART

As shown in FIG. 8, the terminal board may not be used, and the input/output electrodes 38*a*–38*j* may be used as terminals for connecting to the external circuit by bending the input/output electrodes. In the coil 10 of FIG. 8, the terminals and the terminal board can be taken away, and the manufacturing cost of the coil can be reduced. In the above embodiments, the core 54 having cross sectional E shape and the core 56 having cross sectional I shape are used, however the core 54 and 56 each having cross sectional E shape may be used.

The terminals 48 and the terminal holding portion 46 are positioned alternately with a difference of level for putting the input/output electrodes 38*a*–38*j* of the winding part 12 to the cave portion, however it is not necessary to form such cave. In this case, the terminals 48 and the terminal holding portion 46 are formed integrally by means of molding and the like.

This invention is explained in detail and shown by drawings, but this is obvious that this is not to be constructed as the limit of this invention, the sprit and the coverage of this invention is only limited by the statement of the attached claims.

What is claimed is:

1. A coil comprising:

a winding part formed of plural laminated sheets each having plural winding patterns formed thereon;

a core disposed at a center of said winding patterns;

input/output electrodes formed outside of said laminated sheets forming the winding part and connected to ends of said winding patterns; and a terminal board having a plurality of terminals and a plurality of terminal holding portions arranged on said terminal board so that each of the terminals is located between adjacent terminal holding portions, the plurality of terminals and the plurality of terminal holding portions being arranged to form a plurality of caves; wherein at least two of said winding patterns have a different number of turns and are formed on one of said sheets around said core so as to be coaxial in the same winding direction, and said winding part is mounted in said terminal board so that said input/output electrodes are mounted in said caves formed by the plurality of terminals and the plurality of terminal holding portions and so as to connect said input/output electrodes to said terminals.

2. A coil according to claim 1, wherein said plural winding patterns each formed on said plural sheets are connected via a through-hole formed in said sheets, and an end of each of said winding patterns is connected to an input/output portion of one of said input/output electrodes at an outside end of one of said plural laminated sheets.

3. A coil according to claim 1, wherein a width of a lower portion of each of said terminals is narrower than a width of an upper portion of each of said terminals.

4. A coil to claim 3, wherein covers are installed at both sides of said core for covering said winding part.

5. A coil according to claim 2, wherein one of said winding patterns is formed on one of said sheets, and a plurality of said winding patterns are formed on another of said sheets, and each end of said winding patterns on said another of said sheets is connected to different portions of said winding pattern on said one of said sheets.

6. A coil comprising:

a winding part having plural laminated sheets each having plural winding patterns formed thereon;

a core disposed at a center of said winding part;

a plurality of input/output electrodes formed outside of said laminated sheets of said winding part and connected to ends of said winding patterns;

said plurality of input/output electrodes forming a plurality of terminals each having a bent portion; wherein at least two of said winding patterns each having a different number of turns are formed on one of said sheets around said core so as to be coaxial in the same winding direction.

7. The coil of claim 6, wherein said bent portion of each of said terminals comprises a first portion substantially parallel to said laminated sheets, a second portion substantially perpendicular to said first portion and a third portion substantially perpendicular to said second portion.

8. The coil of claim 7, wherein said first portion is connected to said plural laminated sheets and said third portion is formed so as to be surface-mounted to an external circuit.

9. The coil of claim 4, wherein said covers are formed so as to receive said core therebetween.

10. The coil of claim 1, wherein a number of turns of one of said winding patterns on one of said laminated sheets is one and a number of turns of another of said winding patterns on said one of said laminated sheets is 2.5.

11. A coil comprising:

a winding part including a plurality of laminated sheets each having a plurality of winding patterns formed thereon and a plurality of input/output electrodes formed on outer edges of the winding member and being connected to the winding patterns;

a core located within said winding member;

a terminal board having a pair of longitudinal edges, a plurality of terminals and a plurality of terminal holding portions, said plurality of terminals and said plurality of terminal holding portions being alternatingly disposed at each of said pair of longitudinal edges, each of said plurality of terminals being spaced from each of said plurality of terminal holding portions in a direction substantially perpendicular to the longitudinal edges, wherein said winding part is located in said terminal board so that said input/output electrodes are connected to said terminals.

12. The coil of claim 11, wherein the spacing between said plurality of terminals and plurality of terminal holding portions forms a plurality of caves, said input/output electrodes being received in said plurality of caves.

13. The coil of claim 11, wherein said plurality of terminals and said plurality of terminal holding portions are arranged in a substantially straight line, respectively, wherein the substantially straight line formed by the terminals is spaced away from the substantially straight line formed by the terminal holding portions.

14. The coil of claim 11, wherein the terminals are located closer to the longitudinal edges than the terminal holding portions.

15. The coil of claim 11, wherein each of said terminals is formed to have a lower portion that is narrower than an upper portion.

16. The coil of claim 11, wherein said plural winding patterns formed on said plurality of sheets are connected via a through-hole formed in said sheets, and an end of each of said winding patterns is connected to an input/output portion of one of said input/output electrodes at an outside end of one of said plurality of sheets.

17. The coil of claim 11, wherein at least two of said plurality of winding patterns are formed on one of said sheets and have a different number of turns from each other.

18. The coil of claim 17, wherein the number of turns of one of said winding patterns on said one of said laminated sheets is one and the number of turns of another of said windings on said one of said laminated sheets is 2.5.

19. The coil of claim 11, wherein said terminal board has a plurality of grooves formed at a bottom portion thereof, the coil further comprising a plurality of covers for covering said winding part, the covers having projections formed thereon for engaging with said grooves in said bottom portion of said terminal board to secure said plurality of covers to said terminal board.

20. The coil of claim 19, wherein said plurality of covers are formed so as to receive said core therebetween.

* * * * *